US005855623A

United States Patent [19]

English et al.

[11] Patent Number: 5,855,623

[45] Date of Patent: Jan. 5, 1999

[54] PROCESS FOR IMPROVING POLYAMIDE, ACRYLIC, ARAMID, CELLULOSIC AND POLYESTER PROPERTIES, AND MODIFIED POLYMERS PRODUCED THEREBY

[75] Inventors: Larry L. English, Tunnel Hill, Ga.; Ted A. Mallen, Chattanooga, Tenn.

[73] Assignee: Intera Technologies, Inc., Chattanooga, Tenn.

[21] Appl. No.: 710,715

[22] Filed: Sep. 20, 1996

[51] Int. Cl.[6] ..... D06M 13/203; D06M 13/272; D06M 13/256; D06M 13/384

[52] U.S. Cl. ..... 8/115.56; 8/193; 8/194; 8/115.6; 8/115.62; 8/495; 8/539; 8/582; 8/583; 8/586; 8/587; 8/588; 8/589; 8/594; 8/602; 427/389.9; 427/392; 427/393.4; 427/384; 427/385.5; 427/394; 427/396; 428/365; 442/63; 442/93; 442/123; 442/124

[58] Field of Search ..... 8/193, 194, 115.6, 8/115.62, 495, 539, 115.56, 582, 583, 586, 587, 588, 589, 594, 602; 427/389.9, 392, 393.4, 384, 385.5, 394, 396; 428/365; 442/63, 93, 123, 124

[56] References Cited

U.S. PATENT DOCUMENTS

| | | | |
|---|---|---|---|
| 4,672,005 | 6/1987 | Dyer | 428/474.4 |
| 4,743,267 | 5/1988 | Dyer | 8/194 |
| 4,790,907 | 12/1988 | Mallen et al. | 162/157.1 |

*Primary Examiner*—Alan Diamond
*Attorney, Agent, or Firm*—Oblon, Spivak, McClelland, Maier & Neustadt, P.C.

[57] ABSTRACT

Methods are provided for treating polyester, polyamide, acrylic, aramid or cellulosic substrates to improve the uniformity of dyeing and to improve the hydrophilic, soil-release, odor-, mildew-, bacterial- and fungal- resistant properties of these substrates.

37 Claims, No Drawings

PROCESS FOR IMPROVING POLYAMIDE, ACRYLIC, ARAMID, CELLULOSIC AND POLYESTER PROPERTIES, AND MODIFIED POLYMERS PRODUCED THEREBY

BACKGROUND OF THE INVENTION

1. Field of the Invention

The present invention relates to the treatment of polymer substrates to improve the hygroscopic properties, soil release, uniformity of dyeing and the odor-, mildew-, bacterial- and fungal-resistance of substrates, in particular when the substrate is a fabric or fiber. More particularly, the invention relates to the treatment of polyester and polyamide, acrylic, aramid or cellulosic fibers to improve their surface properties.

2. Discussion of the Background

Synthetic polymer materials possess poor surface properties. In particular, most fibers formed from polyester and polyamide are not hygroscopic and have poor odor-, mildew-, bacterial-, fungal-resistant and soil release properties.

Attempts have been made by the prior art to polymerize a water soluble vinyl monomer onto a polymer substrate. This has proved to be particularly difficult with polyester, polyamide, acrylic, aramid and cellulosic substrates.

3. Prior Art Approaches for Polyester

The prior art has attempted at least three general approaches to depositing a water soluble vinyl monomer onto a polyester substrate.

The first approach appears to be by adhesion between the polymerized vinyl monomer and the polymeric substrate. Examples of this approach include U.S. Pat. No. 3,377,249 and U.S. Pat. No. 3,958,932.

The method of U.S. Pat. No. 3,377,249 employs an aminoplast textile resin to effect adhesion of a synthetic acid emulsion polymer to a polymeric substrate. In the method of U.S. Pat. No. 3,958,932 the vinyl polymer is affixed to the polymeric substrate by the use of elevated temperature curing.

A second approach involves entanglement of the polymer formed from the water soluble vinyl monomer into the substrate. In U.S. Pat. No. 3,926,551 water-insoluble polymers derived from acidic vinyl monomers are formed both on the surface and within polyester fibers. In U.S. Pat. No. 3,995,998 polymers derived from both acidic and non-acidic water soluble vinyl monomers are deposited on both the surface and within the fibers forming the polymer substrate. In U.S. Pat. No. 4,065,256 a composition comprising a liquid organic solvent, and a hydrophobic radical polymerization initiator is used to achieve graft polymerization onto both the surface and within a hydrophobic synthetic polymer substrate. In U.S. Pat. No. 4,238,193, an impregnated initiator is used to penetrate into the interior of a polymeric substrate fiber and to effect polymerization of a water soluble vinyl polymer both onto the surface of and within the substrate.

A third approach has been to chemically modify the polymeric substrate so as to receive the polymer from a water soluble vinyl polymerization. U.S. Pat. No. 3,088,791, U.S. Pat. No. 3,107,206, U.S. Pat. No. 3,115,418, and U.S. Pat. No. 3,617,457 each disclose the use of high energy radiation to modify a polymeric substrate. It is believed that the high energy radiation cleaves the bonds on the surface of a polymer to form free radicals. These free radicals participate in chemical reactions with the vinyl monomer. U.S. Pat. No. 3,088,791 irradiates a shaped organic polymer substrate at low temperatures. U.S. Pat. No. 3,107,206 irradiates a stem polymer that has been swollen with a non-polymerizable swelling agent. U.S. Pat. No. 3,115,418 irradiates a polymeric substrate in the presence of oxygen. U.S. Pat. No. 3,617,457 irradiates a polyester substrate and uses unique water soluble vinyl monomers.

U.S. Pat. No. 3,600,122 employs a spark discharge in a zone of free radical initiating gas to generate free radical sites on the surface of a polymeric substrate. This modified polymeric substrate is further reacted like any irradiated polymer.

U.S. Pat. No. 4,043,753 modifies a conventional polyester substrate by incorporating p-carboxycinnamic acid to replace a portion of a terephthalic acid of the polyester. The resultant polymeric substrate is a modified polyester polymer containing an unsaturated group that is susceptible to graft polymerization.

PRIOR ART APPROACHES FOR POLYAMIDE

It is known in the art to attempt to graft-polymerize water-soluble monomers such as acrylic acid, acrylamide, and N,N'-methylene-bis-acrylamide (MBA) onto fibers to impart water absorption properties to the fibers. However, such attempts at graft polymerization have been problematic due to the inability to obtain substantial or even any graft polymerization, long reaction times, the tendency to form large amounts of homopolymers, and difficulties in controlling the process conditions. The raising and control of reaction temperature is extremely critical and sensitive to the formation of excess homopolymers. Excess homopolymers adhere to the inner walls of the processing equipment thus causing both a time and labor-consuming clean-up job. Also, disposal of the residue solution containing a large amount of homopolymers is a source of industrial pollution.

Fabrics thus treated in an environment of excessive homopolymers have their surfaces coated with a thick homopolymer layer which imparts moisture-absorption properties to the fibers. Unfortunately, these properties are not permanent and are lost within about 10 washings. Furthermore, excessive homopolymers tend to cause blotching on treated fabrics which interferes with acceptable commercial dyeing and results in inferior treated fabrics.

In an alternative polymerization process that comprises impregnating fibers with a solution containing a monomer and a polymerization initiator, such as peroxide or persulfate, and heating them, it takes a long period of time to start and advance the polymerization reaction; moreover, the polymers that adhere to fibers are removed quite easily by washing so that their moisture-absorption properties can no longer be retained.

Still another process involves applying a water-soluble vinyl monomer together with a polymerization initiator to fibrous structures and heating them in a non-solvent of the monomer, such as hydrocarbons or the like. This process has problems of industrial hygiene and workability including solvent recovery.

U.S. Pat. No. 3,313,591 describes a process of graft polymerizing ethylenically unsaturated monomers to polyamides to improve various properties of the polymer structure. This process has a one step process using very long times (15 hours or more) and very high concentrations of monomer.

A more recent attempt to cure the deficiency in the prior art is disclosed in U.S. Pat. No. 4,135,877. This patent also discusses a one step process of graft polymerizing selected vinyl monomers to polyamides or fiber structures. According to the process described, polymerization initiators are completely eliminated.

Other patents disclosing the graft polymerization of monomers to polyamides and other polymer structures include U.S. Pat. No. 3,097,185; U.S. Pat. No. 3,099,631; U.S. Pat. No. 3,252,880 and U.S. Pat. No. 3,278,639. However, the methods of these patents involve the use of ionizing radiation in the formation of a polymer melt in order to effect graft polymerization.

While many of these processes result in improved hygroscopic and dye receptive properties, they have not been entirely successful commercially due to the difficulties in obtaining permanent and substantial results and other processing difficulties due to excessive formation of homopolymers which are difficult to remove from the final product and process equipment. Furthermore, some prior art methods require high concentrations of monomer, rather than low concentrations of monomer; and other prior art methods require long reaction times.

The possibility of improving such properties of synthetic fibers in general, including polyamides, is important since many of these fabrics exhibit characteristically undesirable properties such as static cling, poor water absorbency, and poor dye uniformity. Hence, the commercial acceptance of nylon fabrics, for example, has been severely limited.

Furthermore, the prior art approaches frequently suffer from undue expense, complex equipment requirements, and other processing shortcomings.

In addition, economically successful commercial scale treatments of both polyesters and polyamides require an even or level treatment of the entire fibers to obtain uniform improvements in properties for fabrics prepared from the fibers. Uniformity of properties is particularly important when the polyester or polyamide fabric is dyed in order to obtain uniform dye shades throughout the fabric.

SUMMARY OF THE INVENTION

Accordingly, one object of the present invention is to provide an improved process for treating polyester which improves uniformity in fiber surface properties and provides improved hygroscopic, soil release, odor-, bacterial-, mildew- and fungal-resistance, and improved uniformity of dyeing properties.

According to the present invention, a polyester substrate is pretreated with an acidic aqueous mixture containing a hydrophobic vinyl monomer. After suitable contact time and temperature, the substrate is rinsed, and contacted with an acidic aqueous mixture containing a water-soluble vinyl monomer. After a suitable contact time and temperature, polymerization is initiated by a polymerization initiator. Preferably, the initiator is predissolved in water at a reduced temperature and then added slowly over a period of time to the high temperature solution containing the substrate, acid and water soluble vinyl monomer.

A polymer is formed on the substrate whereby the hydrophilic, soil release, uniformity of dyeing and the odor-, mildew-, bacterial-, and fungal-resistance properties of the substrate are improved.

A further object of the invention is to provide an improved process for treating polyamide, acrylic, aramid and cellulosic substrates, including microdenier nylon substrates, to improve the uniformity of polymerization on the substrate, to provide uniform dyeability and to provide even substrate treatment to improve the hydrophilic, soil release, odor-, mildew-, bacterial- and fungal-resistance and dye uniformity properties.

According to the present invention, a polyamide, acrylic, aramid or cellulosic substrate is contacted with an acidic aqueous solution containing an unsaturated polymerizable monomer in a first step to allow intimate contact of the monomer with the substrate surface. After sufficient time and temperature, the initiator is added slowly over a period of time so that the monomer is polymerized to modify the surface of the substrate. Finally, the modified substrate is washed with an alkaline aqueous solution to neutralize acid remaining on the modified substrate.

DETAILED DESCRIPTION OF THE PREFERRED EMBODIMENTS

By "mixture" as used herein is meant any aqueous solution, dispersion, suspension, colloidal solution, emulsion or other aqueous physical aggregation.

By "substrate" as used herein is meant a polymer which is preferably in the form of fibers or fabrics, but may also be in the form of flakes, films, or of suitably shaped formed articles.

By "fiber" is meant monofilaments, multifilament threads, microdenier fibers, batts and staple fibers.

The term "fabrics" is meant to include woven fabrics, knitted fabrics, and nonwoven fabrics.

By "hydrophobic vinyl monomer or hydrophobic monomer" is meant a monomer which is not readily soluble in the surrounding aqueous medium under the conditions of the present invention, and which when employed in the present process, yields a substrate having durable improved surface properties.

By "vinyl polymer" as used herein is meant homopolymers resulting from the vinyl polymerization of the hygroscopic and/or water soluble vinyl monomers, and copolymers thereof.

By "vinyl polymerization" is meant polymerization in which a vinyl group in a monomer participates in the formation of a polymer.

Throughout this application the terms "absorb" and "absorption" will be used to refer generally to the hygroscopic and/or hydrophilic properties of the fibers and fabrics made therefrom. However, these terms also refer to related hygroscopic and/or hydrophilic properties such as adsorption, moisture transport, wicking, wettability, etc. Thus, although the term "adsorption" may be more appropriate for referring to the attraction of water to the outer surfaces of fibers per se, and the term "absorption" may be more appropriate for referring to the dispersal of moisture in the interstices between the fibers of a fabric, the term "absorption" will be used for convenience to refer to both phenomena.

Also throughout this application, the term "dosing" and "slowly adding" are used to refer to the manner in which the polymerization initiator or a solution containing the initiator are introduced during the process of the invention. These terms refer to the direct addition of initiator or initiator solution to a polymerization bath containing the desired monomer or monomer mixture. In this invention, the initiator is added to the polymerization bath over a time period which is greater than 3 minutes. However, these terms also refer to the introduction of the initiator into the polymerization bath containing monomers in any manner in which the initiator becomes active over a period of time greater than 3 minutes. Thus, these terms are meant to include dosing in a manner in which the initiator is added to the polymerization bath in an inactive form and becomes an active polymerization initiator over a time period of greater than 3 minutes. That is, these terms include adding an initiator to the polymerization bath over any time period, even a time period of less than 3 minutes, provided that the initiator is activated, becoming an active initiator over a time period of greater than 3 minutes. Such a "timed release" initiation includes timed release initiation due to encapsulation of the initiator, timed release due to pH changes in the polymerization bath, timed release due to chemical additions to the polymerization bath, timed release due to radiation, vibration, etc.

Wherever the present disclosure refers to fiber surfaces or intimate contact of the monomer with fiber surfaces or like expressions, the individual fibers or filaments are being referred to such that contact and attachment of the monomer and graft polymer is with the surfaces of individual filaments of a multifilament thread or bundle.

The present invention is directed to the treatment of polyester substrates and the treatment of polyamide, acrylic, aramid and cellulosic substrates. These substrates may be treated individually or may be treated as blends or mixtures of these fiber substrates with each other and with other fibers, for example cellulose fibers. In blends or mixtures, the substrate to be treated will generally be present in an amount ranging from about 10–95 wt. % relative to the total weight of the blend or mixture.

Treatment of Polyester

Polyester is the generic name for a fiber manufactured either as a staple fiber or continuous filament in which the fiber-forming substance is any long chain synthetic polymer composed of at least 85% by weight of an ester of a dihydric alcohol and a dicarboxylic acid. The most common polyester fibers available in the United States are made of polyethylene terephthalate, and are available for example under the trademarks DACRON of E. I. dupont de Nemours & Co., FORTREL of ICI United States, Inc. and from Celanese Chemical Co., and TREVIRA from Hoechst-Celanese Co. Polyester fibers are available as filament yarn, staple fibers and fiber tows and are often combined with other fibers, such as cotton and wool. For example, much clothing is made from yarns which are a blend of polyester and cotton staple fibers. Fabrics made from such polyester fibers and fiber combinations are commonly used for making many types of outerwear, including dresses, suits, shirts, etc. Such blends may be used as the substrates of the invention.

Polyesters form excellent fabrics and can be produced economically on a mass production basis, but polyesters suffer from many drawbacks. Polyesters lack the ability to significantly absorb water and are subject to odor-, bacteria-, mildew-, and fungal-resistance problems and soil-release problems. By treating polyester fibers according to the process of this embodiment, a most useful fabric is formed which has very good water absorbing and soil-release, odor-, bacterial-, fungal-, and mildew-resistant properties which are retained after many washings.

Suitable non-limiting examples of water soluble vinyl monomers that may be used in this embodiment include N,N'-methylenebisacrylamide termed MBA, N,N'-(1,2-dihydroxyethylene)bisacrylamide, acrylamide, acrylic acid, 2propyl-1-ol, crotonic acid, tetraethylene glycol diacrylate, vinylpyridine, methacrylic acid, methacrylamide, 4-methylolacrylamide, N-methyl-N-vinyl formamide, N-vinyl pyrrolidone, 3-, 4-, or 5-methyl-N-vinyl pyrrolidone, maleic acid, vinyl oxyethylformamide, acrylonitrile, methacrylonitrile, methallylalcohol, acrylyl cyanide, styrene sulfonic acid, and water soluble salts of styrene sulfonic acid.

The preferred water soluble vinyl monomers are N,N'-methylenebisacrylamide (MBA) and N,N'-(1,2-dihydroxyethylene)bisacrylamide. In some instances, two or more water soluble vinyl monomers may be copolymerized to yield the polymer used in this embodiment, such as maleic acid with MBA. Thus, some of the above monomers do not readily homopolymerize, but will copolymerize with other monomers, as is well known in the art.

The hydrophobic vinyl monomers are preferably cross-linking, namely have at least two reactive vinyl functional groups. The hydrophobic monomers are also preferably emulsifiable. Suitable non-limiting examples of emulsifiable cross-linking hydrophobic vinyl monomers that may be utilized in this embodiment include bisphenol A dimethacrylate, ethylene glycol dimethacrylate, ethoxylated bisphenol A dimethacrylate, allyl acrylate, allyl methacrylate, 1,3-butylene glycol diacrylate, 1,3-butylene glycol dimethacrylate, 1,4-butanediol diacrylate, diallyl fumarate, diethylene glycol diacrylate, 2,2-dimethylpropane 1,3-diacrylate, 2,2-dimethylpropane 1,3-dimethacrylate, dipentaerythritol monohydroxypentaacrylate, ethoxylated bisphenol A diacrylate, 1,6-hexanediol diacrylate, 1,6-hexanediol dimethacrylate, pentaerythritol tetraacrylate, pentaerythritol triacrylate, pentaerythritol tetramethacrylate, trimethylolpropane triacrylate, trimethylolpropane trimethacrylate, and tripropylene glycol diacrylate. The preferred emulsifiable hydrophobic vinyl monomers are ethylene glycol dimethacrylate and ethoxylated bisphenol A dimethacrylate. A plurality of hydrophobic vinyl monomers may be copolymerized.

Prior to the polymerization, the hydrophobic vinyl monomers are contacted with the substrate. Preferably, a suitable emulsion of the hydrophobic vinyl monomers should be formed, with such emulsion contacting the substrate. By suitable emulsion as used herein is meant an emulsion in which no droplets are visible to the naked eye. Normally, in accordance with this embodiment, the initial emulsion is milky in appearance. This milky appearance may be clarified somewhat or clarified completely as the hydrophobic vinyl monomer is withdrawn from the emulsion to the substrate. An appropriate concentration of emulsifying agent or surfactant should be used. If the concentration is too low, there will not be a suitable emulsion and there will not be even intimate contact between the hydrophobic monomer and the substrate. It is preferred to avoid the deposition of globs of visible particles of hydrophobic vinyl monomer.

In the absence of the contact of hydrophobic vinyl monomer with the substrate, the polymer derived from the water soluble vinyl monomer is relatively loosely affixed to the substrate and most of the improved properties attributable to this polymer are rapidly lost during washing. Polymers prepared from the hydrophobic vinyl monomer alone do not have the desirable surface properties achieved by the polymers of the invention.

Although not necessary to the operability of the invention, there is preferably a period of time prior to the polymerization reaction when the hydrophobic monomer is dispersed adjacent to the substrate so that adequate contact between the hydrophobic monomer and the substrate is achieved. Preferably, an even deposition of the hydrophobic vinyl monomer on the substrate is secured. This period of time can vary greatly, and is normally between about 30 seconds to as much as about 30 minutes or longer.

Generally, the substrate/monomer solution bath is heated to improve the contact of the monomer with the substrate prior to addition of the initiator. Temperatures in the range between about 80°–100° C. are suitable with preferred temperatures in the range of about 90°–95° C.

A surfactant may be used to prepare the emulsion. The choice of surfactant and the amount of surfactant is limited to those that do not significantly interfere with the polymerization reaction and interaction between the water soluble vinyl monomer, the hydrophobic monomer and the fiber. The determination of whether a given surfactant or the amount of a surfactant significantly interferes with such polymerization reaction and interaction may be done by routine preliminary testing within the skill of one of ordinary skill in the art.

A wide variety of surfactants can be used in the present invention. Examples include anionic surfactants such as alkyl sulfonates, alkyl sulfate, sulfated oil or fat, sulfated glycol ester, sulfated alkanolamide, sulfated alkylphenol polyglycol, sodium xylene sulfonate, sodium dibutyl naphthalene sulfonate, sodium dodecylbenzene sulfonate, sodium sulfonate of naphthalene formaldehyde condensate, sulfonated amide, monoalkyl phosphate salt, dialkyl phosphate salt, trialkyl phosphate, neutralized carboxylic acids (i.e. sodium stearate) and sulfated ethers.

Suitable surfactants also include amphoteric examples such as alkyl glycine, N-alkylbetaine, imidazoline glycine, sulfated polyglycol amine, and alkyl amine sulfonate.

Further suitable surfactants include cationic examples such as quaternary ammonium compounds, fatty amine salts, alkylamine polyoxyethanol glycols, fatty alkyl dimethyl benzyl ammonium chloride, lauryl pyridinium chloride, N-acyl,N'-hydroxyethyl ethylene diamine, N-alkyl, N'-hydroxyethyl imidazoline and amino amides.

Nonionic surfactants may also be used. Suitable examples include ethoxylated fatty alcohols, ethoxylated long branch chain alcohols, and ethoxylated alkyl aryl alcohols, and ethoxylated fatty amines. Other suitable nonionic surfactants include polyethylene glycol esters and polyethylene glycol amides.

Following the application of the emulsified hydrophobic monomer, a new acidic solution of the water-soluble vinyl monomer is allowed to contact the substrate. After a suitable time and temperature, the initiator is optionally mixed with water at low temperature (about 40°–60° C.) and added to the monomer solution slowly over a period of time.

An important aspect of the present invention is the manner of addition of the polymerization initiator to the monomer/substrate polymerization bath after the substrate has been contacted with the monomers. In conventional polymerizations, the initiator is generally added as a single portion after addition of the monomers to the polymerization bath, generally over a short time period of perhaps 1–3 minutes. In contrast to this conventional process, in the process of this invention, the initiator is added by dosing the initiator or an initiator solution into the polymerization bath containing substrate and water-soluble monomers. This dosing of initiator in the invention occurs over a time period which is greater than 3 minutes. Preferably, the initiator is dosed into a polymerization bath continuously or in a plurality of portions over a time period ranging from 5 minutes to about 30 minutes, more preferably over a time period ranging from 10 minutes to 15 minutes.

The choice of the polymerization initiator depends on the type of monomer, temperature of polymerization that was utilized, and other parameters. The application of suitable initiators to both the water soluble vinyl monomers and the emulsifiable hydrophobic vinyl monomers is well-known in the art. The selection of suitable conditions for a particular initiator is within the skill of one having ordinary skill in the art and may be readily determined by simple testing within the skill of a person having ordinary skill in the art.

In a particularly preferred embodiment, the temperature of the water soluble vinyl monomer solution containing substrate is heated to 80°–100° C., more preferably 85°–95° C. Then after a suitable time, the initiator or initiator solution is slowly added to the solution containing monomer and substrate. Surprisingly, use of lower mixing temperatures and slow addition of initiator over a longer period of time result in improved uniformity of polymerization on the substrate. Additionally, a further unexpected result is the substantially improved thermal stability of the treated fabric during heat setting and improved durability to laundering.

Non-limiting examples of polymerization initiators that may be utilized in this embodiment include inorganic peroxides, e.g., hydrogen peroxide, barium peroxide, magnesium peroxide, etc., and various organic peroxy compounds illustrative examples of which are the dialkyl peroxides, e.g., diethyl peroxide, dipropyl peroxide, dilauryl peroxide, dioleyl peroxide, distearyl peroxide, di-(tert-butyl) peroxide and di-(tert-amyl) peroxide, such peroxides often being designated as ethyl, propyl, lauryl, oleyl, stearyl, tertbutyl and tert-amyl peroxides; the alkyl hydrogen peroxides, e.g. tert-butyl hydrogen peroxide (tert-butyl hydroperoxide), tert-amyl hydrogen peroxide (tert-amyl hydroperoxide), etc., symmetrical diacyl peroxides, such as acetyl peroxide, propionyl peroxide, lauroyl peroxide, stearoyl peroxide, malonyl peroxide, succinyl peroxide, phthaloyl peroxide, benzoyl peroxide, etc., fatty oil acid peroxides, e.g., coconut oil peroxides, etc., unsymmetrical or mixed diacyl peroxides, e.g., acetyl benzoyl peroxide, propionyl benzoyl peroxide, etc., terpene oxides, e.g., ascaridoic, etc., and salts of inorganic peracids, e.g., ammonium persulfate and potassium persulfate.

Initiators also include ceric ions, for example, in the form of ceric salts such as ceric nitrate, ceric sulfate, ceric ammonium nitrate, ceric ammonium sulfate, ceric ammonium pyrophosphate, ceric iodate, and the like.

Non-limiting examples of suitable acid initiators for use in the invention include hydrochloric, phosphoric, sulfuric, nitric, acetic, formic, oxalic, tartaric, monochloroacetic, dichloroacetic, trichloroacetic and similar acids.

The polymerization should preferably occur in the presence of a catalyst. The acid initiators listed above, namely hydrochloric, phosphoric, sulfuric, nitric, acetic, formic, oxalic, tartaric, monochloroacetic, dichloroacetic, trichloroacetic and similar acids may function as both polymerization initiators and polymerization catalysts. When other forms of polymerization initiators are used, the presence of an additional catalyst may be desirable. Each of the aforementioned acids may function as a catalyst. In addition, other well-known polymerization catalysts include bases such as potassium hydroxide and sodium hydroxide, and other recognized catalysts including ferrous sulfate.

The time duration for the polymerization of the water soluble vinyl polymer should be between about 30 seconds and 30 minutes, preferably about 10–25 minutes. Generally, the time duration is not critical, but the time should be sufficient for the polymerization to take place.

While the process of this embodiment may be used at any of a number of stages during the usual processing of polymer fibers or fabrics, or other substrates, it has been found preferable to use the process before the dyeing of the fibers or before there is any treatment of the fibers which would result in encapsulation or coating of the fiber surface. It is common practice to apply lubricants, softeners or other fiber treatment chemicals as a final operation on fabrics in conjunction with dyeing and heat setting, and such coating may often interfere with the present process. To the extent that there would still be improvement in surface properties, the improvement would be gradually washed off through many washings.

Therefore, it is preferable that the fibers be scoured and rinsed prior to carrying out the treatment process of the present invention in order to remove soil, finish oils, and other contaminants which may be present on the fibers. After the process of this embodiment, it is preferable to drain the treating solution and rinse the fibers before dyeing, in order to remove acid and excess homopolymer, which may interfere with reaction of the dye with the dye sites.

Uniform dispersal and intimate contact of all chemicals is preferred. In the case of fibers this may be assisted by various forms of agitation or flow of the aqueous treating solution around and between the fiber surfaces. For example, in the case of the treatment of fibers in the form of fabric piece goods, agitation may be accomplished by the paddles in a conventional paddle tub. Alternatively, for fibers in the form of fabrics which are processed in the form of rolls on a beam, the aqueous treating solution may be circulated around and through the beam by conventional pressure means.

The time necessary for attaining uniform dispersal, intimate contact and attachment onto the substrate will vary with the particular method of contacting the substrate with the aqueous solution, and may range from one second to thirty minutes. Although it is possible that the aqueous solution could be contacted with the fibers by spraying, paddling, dipping or other means, it is most preferable to immerse the fibers in a bath formed by the aqueous solution. Using such immersion techniques, relatively short periods of time are necessary before polymerization may begin. For example, about 10 minutes is usually sufficient with adequate agitation or circulation of the aqueous solution.

The process can be controlled by restricting any one or more of the controlling factors of heat, time, initiator, catalyst, or monomer addition. Thus, by way of example and not by way of limitation, the monomers, catalysts, and substrate may be placed in an aqueous medium with agitation, with the aqueous medium being brought up to the appropriate temperature. The polymerization process can then be triggered by the addition of the initiator.

In a particularly preferred embodiment, the substrate is first immersed in the water. Thereafter, the hydrophobic vinyl monomer and the surfactant are added to the water. A suitable weight percentage range for the hydrophobic vinyl monomer is normally between about 0.02 to 2.0 weight percent based on the weight of substrate and a suitable weight percentage range for the surfactant is any weight percentage range that achieves an emulsion that remains suitable throughout the process. The upper and lower limits of concentration for the hydrophobic vinyl monomer may be determined for any given combination of substrate, water soluble and hydrophobic vinyl monomers, initiators, catalysts and temperature by routine testing to determine durability of retention of improved surface properties after about 20 machine washings. Such tests for a given combination should indicate whether a particular desired improvement of surface properties for the substrate, such as improved hydrophilic, soil-release, odor-, fungal-, bacterial- and mildew-resistance properties, is retained by the substrate.

The system is agitated for a sufficient period of time for dispersal and contact of the components. A period of time of between about 30 seconds to 30 minutes may be used. Routine testing may be used to determine a satisfactory time period.

The system is preferably maintained under agitation throughout the process. Such agitation will result in better emulsification and dispersal of the hydrophobic vinyl monomer, so that a suitable emulsion of such monomer is obtained.

In the preferred process, after suitable contact time with the hydrophobic vinyl monomer, a new solution containing the water soluble vinyl monomer is then added in a concentration between of preferably about 0.002 to 10 weight percent on weight of the mixture. The concentration of the water soluble vinyl monomer is normally not critical in terms of a desirable product, and may be varied. Upper and lower limits may be readily determined by routine testing for improved surface properties of the substrate.

The weight percentage concentration of the catalyst will depend upon the nature of the catalyst. This is readily determinable by simple tests within the skill of one having ordinary skill in the art. By way of example, suitable concentrations for hydrochloric acid are such that a pH between about 2 and 4 is achieved.

The particular concentrations of the monomers, catalysts and the initiator in the treating solution will vary widely depending upon such factors as the nature of the particular monomers, catalyst and initiator, the time and temperature of the treatment, and the nature and form of the substrate being treated. While certain concentrations, catalysts, and initiators may be needed under a given set of treatment conditions, those of ordinary skill in the art will be able to optimize the concentrations by routine experimentation on the basis of the present disclosure.

Attaining the desired degree of treatment according to this invention depends on the strength of the initiator and the concentration of the monomers and catalyst. Thus, for example, a strong initiator, as for example a free radical initiator that forms relatively high concentrations of free radicals and/or a high weight concentration of initiator, could require a lower water soluble vinyl monomer concentration. Conversely, a weak initiator, namely one that is inherently weak and/or present in a low concentration, would require a higher monomer concentration. In the latter case, the treatment according to this invention can be controlled by draining the initiator containing solution from the fabric once the desired extent of polymerization has been achieved.

After polymerization begins, such polymerization being a function of the concentration and type or the catalyst, temperature, the vinyl monomers, substrate, initiator and type of equipment being used, the substrate is allowed to remain in the treating solution at a temperature long enough to assure that uniform graft polymerization ("substantial polymerization") has occurred, such time usually being between about 30 seconds and 30 minutes. The fibers can then be rinsed with water to neutralize the pH and remove excess homopolymers, if any.

After the polyester substrate has been treated according to the process of the invention, the substrate may be dyed using conventional dyeing processes and conventional dyes for polyesters. The treated fabric, dyed or undyed, is suitable for preparation of fabric articles, for example clothing articles. Clothing articles prepared from the treated fabric dry quickly and draw moisture away from the body providing improved wearing characteristics. The treated fabric may be conventionally laundered and the treated fabric retains its improved properties over many laundering cycles.

In a further embodiment, cationic dyeable polyester is used as the substrate. Such polyester possessing active anionic dye sites, for example $SO_3^-$ groups, is well-known in the art and commercially available, for example, THERMASTAT from E. I. duPont de Nemours Co.

When cationic dyeable polyester substrates are used, it is not necessary to use a cross-linking hydrophobic vinyl monomer. This process has the advantages of lower monomer cost as well as decreased processing time. This result is surprising since the cross-linking hydrophobic monomer confers durable properties to the graft polymer when conventional polyester is treated. In this embodiment, the water-soluble vinyl monomer described above is used in the manner described above for regular polyester. That is, the anionic polyester is contacted with a heated solution of water-soluble monomer for a suitable time and at a suitable temperature and then the initiator is slowly added as discussed above. After polymerization, the treated anionic polyester can be further processed as discussed above for non-anionic polyester.

In this embodiment, a cationic initiator is used to initiate polymerization. Suitable cationic initiators are cationic azo initiators in which a free radical is formed by cleavage of the azo group and a cationic charge is located on a nitrogen atom of the initiator. Suitable initiators include 2,2'-azobis (N,N'-dimethyleneisobutyramidine) dihydrochloride, 2,2'-azobis (2-amidinopropane) dihydrochloride, 2,2'-azobis (N,N'-dimethyleneisobutyramidine), etc. Such cationic azo initiators are commercially available, for example, from Wako Pure Chemical Industries. The cationic initiator is added slowly over a time period of greater than 3 minutes, preferably ranging from 5 minutes to 30 minutes, more preferably 10–15 minutes.

The pH of the aqueous water-soluble monomer mixture is preferably maintained at a pH of about 4–6, more preferably about pH 5, by addition of acid, e.g., (acetic acid) in this embodiment. Improved results using cationic dyeable polyester are attained when the initiator is slowly dosed into the aqueous monomer mixture at temperatures of about 80°–100° C., preferably 90°–95° C.

Sodium sulfate or other salts may be added to the aqueous monomer mixture in order to drive the reaction products out of solution and into contact with the fiber.

The treated anionic polyester is dyeable using conventional dyes for anionic polyester and conventional dyeing equipment well known in the art.

In yet another embodiment, a polyester substrate may be treated using the process of the present invention in a continuous processing mode. In this embodiment, the polyester is prepared and scoured as discussed above to remove knitting oils, waxes, etc. The water-soluble monomer and cross-linking hydrophobic monomer, acid and initiator are separately dissolved in water and then mixed together using metering pumps and mixing manifolds. The mixed solutions are delivered to the pad of conventional pad/steam processing equipment which is well-known and used in carpeting and cotton-dyeing processes. The mixed solutions are contacted with the polyester substrate at the padder. After squeezing to remove excess liquid, the substrate contacted with the monomers and initiator then enters a chamber containing saturated steam at about 98°–100° C. for a sufficient time to complete polymerization. Generally, a sufficient time is about 5–25 minutes, preferably about 10–15 minutes. The treated substrate is then rinsed with water for a time and at a temperature sufficient to remove acid and non-exhausted reactants. The fabric may then be dried and dyed in conventional dyeing apparatus. In this embodiment, it is necessary to use a cross-linking hydrophobic monomer.

In a further embodiment of the invention, a polyester substrate may be dyed and processed according to the invention in a combined dye/process mode. A combined dye/process has enormous economic benefit due to the reduction in lengthy cycle times required for sequential processing.

In this embodiment, a suitable conventional dye, a portion (preferably about 40–60 wt. % of the total monomer) of the water-soluble monomer and sufficient acid to render the pH of the solution suitable for dyeing (generally a pH of about 4–6) are heated to a temperature of about 120°–135° C., preferably 130°–135° C. and contacted with the polyester substrate for a suitable time, generally about 5–60 minutes. If desired a salt such as sodium sulfate, may be added to exhaust the dye and reaction products onto the substrate. After the dye cycle, the solution is cooled (generally to about 80°–100° C.). The remainder of the monomer is then added to the dye bath and the pH is adjusted to lower pH by the addition of acid or a buffered acid/base solution to a pH suitable for initiation of polymerization and treatment of the polyester according to the process of the invention as described above. Generally, about 1–2% by weight monomer is used in this embodiment relative to the total weight of the polyester substrate. A suitable pH is in the range of about 2–4, preferably about pH 3. Thereafter, the initiator is slowly added to the dye bath/polymerization bath over a period of time of 3 minutes or longer, preferably 5–30 minutes, more preferably about 15–20 minutes. Polymerization is conducted for a time sufficient to polymerize the monomer onto the substrate, generally about 5–30 minutes, preferably about 10–20 minutes, and then the dyed and treated substrate is washed and further processed as described above.

Treatment of Polyamide, Acrylic, Aramid and Cellulosics

Polyamides are high molecular weight polymers in which amide linkages (CONH) occur along the molecule chain. Preferred polyamides are the synthetic linear condensation polyamides. Such polyamides include for example poly (hexamethylamine adipamide), which is prepared by the well known reaction of polycarboxylic acid such as adipic acid (or an amide-forming derivative thereof) with a polyamine such as hexamethylene diamine. The most common commercially available polyamides of this type in the United States are nylon 6,6 which is polyhexamethylene adipamide, and nylon 6 which is poly(hexamethylene caprolactam). These types of nylons are commonly extruded as filaments over a wide dimensional range, oriented by cold-drawing and knitted into many different forms of fabrics. Nylons are excellent fabrics and can be produced economically on a mass production basis, but nylon suffers from many drawbacks. Nylon lacks the ability to absorb water and is subject to odor-, bacteria-, mildew-, and fungal-resistance problems and soil-release problems. By treating nylon according to the process of this embodiment, a useful fabric is formed which has very good water absorbing, odor-, bacteria-, mildew-, and fungal-resistance properties and soil release properties which are retained after many washings.

Non-limiting examples of polyamide fibers include nylon 6,6, nylon 6, wool and silk. The term "fibrous structures" includes continuous filaments, multifilament threads, batts, staple fibers, woven or knitted fabrics, and non-woven fabrics, and the like composed of at least one kind of the fibers mentioned above. As used herein, the term "polymer fibers" will be understood to include fibrous structures such as the above and others. Wherever the present disclosure refers to fiber surfaces or intimate contact of the monomer with fiber surfaces or like expressions, it will be understood that the individual fibers of filaments are being referred to, such that contact and attachment of the monomer and graft polymer is with the surfaces of individual filaments of a multifilament thread or bundle, for example.

Acrylic is a generic name for fibers in which the fiber-forming substance is any long chain synthetic polymer composed of at least 85% by weight of acrylonitrile (—$CH_2CH(CN)$—) units. Acrylic fibers are commerically available as ORLON from E. I. duPont Nemours and Company (dupont) and CRESLAN from American Cyanamid Company, for example. Acrylic fibers may be blended with other fibers such as wool or nylon. Modacrylic fibers are also considered to be within the scope of the present invention. Modacrylic fibers contain less than 85% by weight, but at least 35% by weight acrylonitrile units. Modacrylic fibers are also commerically available, for example, as SEF modacrylic from Monsanto. Additional monomers which are typically present in acrylics include vinyl chloride and vinylidine chloride.

Aramid fibers are aromatic polyamides formed by reactions that lead to the formation of amide linkages between aromatic rings. Generally, aramid fibers are prepared by reacting aromatic diamines and aromatic diacid chlorides in a solvent. Solutions of these polymers produce fibers having excellent heat and flame resistance and fibers having good tensile strength and modulus. Aramid fibers are formed from long-chain synthetic polyamides in which at least 85% of the amide linkages are attached directly to two aromatic rings. Aramid fibers which may be treated by the process of the invention include aramids in which at least 85% of the amide linkages are directly joined to two aromatic rings and in which imide groups may be substituted for up to 50% of the amide groups (aromatic polyamide-imide polymers). Aramid fibers have been commercially available since the 1960's and include poly(m-phenylene isophthalamide) sold as NOMEX by duPont and CONEX by Teijin. Poly(p-phenylene teraphthalamide) is commercially available as KEVLAR from duPont. Other suitable aramid fibers are disclosed in the Encyclopedia of Chemical Technology, 3rd Edition, volume 3, pages 216–218 and the references cited therein.

Cellulosic fibers include cotton, rayon and fibers prepared from cellulose esters by esterifying cellulose. Any cotton fiber suitable for manufacturing fabric may be used in the present invention. The cotton may be of any suitable grade and staple length. Cotton fiber is commercially available and well known in the art. The cotton fibers described in the Encyclopedia of Chemical Technology, 3rd Edition, volume 7, pages 176–195 and the references cited therein may be used in this invention. Rayon fiber has been known in this art since the late 1950's and is prepared from cellulose. Suitable rayon fiber for use in the present invention include viscose rayon, solvent-spun rayon and cuprammonium rayon. Rayon disclosed in the Encyclopedia of Chemical Technology, 3rd Edition, volume 19, pages 855–880 and references cited therein may be used in the process of the invention. Suitable cellulosics include cellulose acetate and cellulose triacetate which are prepared by esterifying cellulose with acetic anhydride. These polymers are commercially available and widely used in the preparation of textile fabrics. Suitable cellulose esters for use in the process of the invention are disclosed in the Encyclopedia of Chemical Technology, 4th Edition, volume 10, pages 598–624 and the references cited therein.

The process of treating polyamide, acrylic, aramid and cellulosic substrates is described below with reference to polyamide fibers for convenience. However, treatment of each polymer substrate and blends thereof and substrates having other forms is contemplated in the process of the invention. The treatment process has the following basic steps: (1) The polyamide fibers are preferably initially scoured with an aqueous alkaline solution. This initial scouring step improves the uniform polymerization of the monomer on the substrate fibers. (2) The scoured fibers are contacted with an aqueous solution having a pH below 7 but above where acid degradation of the polymer fiber occurs, and a temperature between about 75° C. and about 100° C. and containing at least one unsaturated monomer. In this step, the surface of the polymer fiber is affected and has essentially single molecule addition of a monomer pendent to the polymer fiber. The solution is preferably agitated or forced to flow among the fibers for a sufficient time to allow uniform dispersal and intimate contact of the monomer with the fiber surfaces. (3) Thereafter polymerization of the monomer on the polymer fiber surfaces is initiated using a polymerization initiator, such as a persulfate or peroxide compound. The polymerization is then continued for a sufficient time to allow substantial graft polymerization of the monomer on the fiber surfaces to modify the surface characteristics of the polymer fibers.

With most vinyl monomers and most synthetic polymer fibers the maximum weight percent of add-on graft polymer should be below about 1.0%. Thus, additional graft polymer above 1.0% is rapidly lost on washing. It is usually disadvantageous to exceed this weight percent value of add-on polymer, since to do so may result in splotches on the outer surface of fabric formed from the polymer fibers, as well as material waste, cleanliness and pollution problems. The time duration for the step of monomer attachment to the surface may vary between one second and thirty minutes. Longer durations may be used than thirty minutes. However, such longer durations will normally not significantly improve the monomer attachment.

The polymer fibers should not be degraded. Conditions resulting in polymer fiber degradation are to be avoided. By way of example, high concentrations of acrylic acid and other monomers may lead to degradation of the polymer fibers.

The polymer fibers are preferably immersed in the treating solution, usually in the form of a knitted, woven or nonwoven fabric, and many variations are possible in the order of addition of the various components to the treating solution. A preferred monomer for use in the invention is N,N'-methylene-bis-acrylamide. The pH of the solution may be adjusted by addition of an acid or by use of an acid monomer. The treatment is preferably carried out at low concentrations of monomer and polymerization initiator and for short periods of time so as to avoid as much as possible substantial homopolymerization of the monomer.

The polyamide substrate is initially scoured with a basic aqueous solution to cleanse the fibers by removing processing oils, etc. Preferably, the alkaline solution has a pH of about 9–11, more preferably 10.5–11. Suitable alkaline solutions are prepared by addition of sodium phosphate, trisodium phosphate (TSP), tetrasodium pyrophosphate (TSPP), ammonia, soda ash or sodium hydroxide. In a preferred embodiment, a scouring agent such as ethoxylated nonylphenol, alcohol ethoxylates, alcohol sulfonates, alkyl benzenesulfonates, phosphate esters, etc. is added to the alkaline solution in an amount of about 1–3% by weight, relative to the aqueous solution. The initial alkaline scouring step removes knitting oils, waxes, etc.

The polymerization temperature at which fibers or fibrous structures are treated in accordance with this embodiment is between 85° C. and about 95° C.

The process of this embodiment differs from those of the prior art in that polymerization of the monomer to be graft polymerized onto the polymer fibers is delayed until there has been intimate contact of the monomer and acid with the surface of the heated polymer fiber. Thus, while applicant does not wish to be bound by any particular theory or mechanism of reaction, it is believed that the unsaturated monomer first attaches to the polymer chain on a molecule by molecule basis in the presence of acid and heat. Thereafter, when the polymerization is initiated by addition or activation of a polymerization initiator, the monomer begins to polymerize so that there is chain addition of monomer to the sites of single monomer additions initially grafted onto the polymer fibers. If significant homopolymerization of the monomer takes place prior to the alteration and monomer attachment to the fibers, most of it will simply be washed off the fibers so that there will be no significant permanent improvement in the surface properties of the fibers.

Accordingly, the second step of this embodiment is the formation of an aqueous treating solution with dissolved monomer having an acidic pH (i.e. below about 7 and above a pH where acid degradation occurs) and heated to a temperature of about 75° C. to about 100° C. and preferably in the range of about 90° C. to 95° C. While temperatures above 100° C. are possible, they make processing more difficult and may make subsequent polymerization difficult to control.

It is not necessary that the temperature be constant throughout the process. For example, the polymerizing solution could be formed at about 70° C., or such temperature as will allow ready dissolving of the monomer and/or acid in the solution, and then the temperature could be raised to the desired level for the attachment of the monomer just prior to initiation of graft polymerization. The attachment of a monomer should be such as to effect essentially single molecule addition of the monomer pendent to the polymer chain to form a branched polymer with substantially no graft polymerization of said monomer. This single molecule addition is discussed in U.S. Pat. No. 5,154,727, the disclosure of which is incorporated herein by reference in its entirety. Thus, since graft polymerization is to be avoided, it is not necessary to add any polymerization initiators. Moreover, in the case of acrylamide and other monomers having a low degree of reactivity, it is also not normally necessary to use a polymerization inhibitor in the solution. However, with some monomers which more rapidly polymerize, it may be desirable to include in the solution one or more polymerization inhibitors, which are known in the art for the particular monomer selected.

Those of ordinary skill in the art will recognize that the proper extent of treatment can be determined by detecting the onset of homopolymerization of the monomer in the treatment solution. Thus, since graft polymerization is normally accompanied or preceded by homopolymerization of the monomer, which homopolymerization appears as a precipitate or cloudiness in the treatment solution, the formation of homopolymers should be avoided in this step. Of course, while the invention seeks to obtain essentially single molecule additions of the monomer to the polymer chains, it will be understood that there will inevitably be some amounts of graft dimerization and/or trimerization on the polyamides and in the treatment solution. Theoretically, there can be a maximum addition of one molecule to every six units of the polymer chain in the case of nylon 6,6 or nylon 6. However, accurate determinations of the exact numbers of additions are difficult on a simple weight basis since nylon picks up about 5 percent water, and the total addition of monomer to a polymer is generally too small to measure.

Although the preferred practice of this embodiment seeks to obtain essentially single molecule addition of the monomer to the polymer chains in this step of the process, the addition of dimers and trimers of the monomer is also satisfactory. Therefore, as used herein, the term "essentially single molecule addition" will be understood to include additions of single, double and triple molecules of the monomer to the polymer chains in this step of the process. Significant additions of anything larger than trimers would be considered graft polymerization and is therefore to be avoided.

The temperature in the third step (polymerization) is maintained at whatever level is necessary to obtain the optimum speed and degree of graft polymerization. For example, the temperature could be maintained at the same temperature as the previous step or could be raised to about 90° C. to 95° C. at the end of the previous step and maintained at that temperature for the remainder of the treatment process. Generally, there would normally be no occasion in which the temperature in the third step is below the temperature of the second step.

The acid, monomer, fabric and heat may be combined in the second step of the treatment process in virtually any desired order, so long as each of these four elements is present prior to initiating polymerization for a sufficient time to allow uniform dispersal and intimate contact of the monomer with the fiber surfaces. For example, the order of combination in the second step may be any of the following: (1) addition of acid and monomer to water and heating to the desired temperature; (2) addition of monomer, addition of acid and heating to the desired temperature; (3) addition of monomer to water, heating to desired temperature and addition of acid; or (4) addition of acid monomer to water and heating to desired temperature. Other possible orders of carrying out the second step will be evident to those skilled in the art based on the present disclosure.

Uniform dispersal and intimate contact may be assisted by various forms of agitation or flow of the aqueous treating solution around and between the fiber surfaces in the form of fabric piece goods, agitation may be accomplished by the paddles in a conventional paddle tub. Alternatively, for fibers in the form of fabrics which are processed in the form of rolls on a beam, the aqueous treating solution may be circulated around and through the beam by conventional pressure means.

The time necessary for attaining uniform dispersal intimate contact and attachment of the monomer to the polymer fibers will vary with the particular method of contacting the fibers with the aqueous solution, and may range from one second to thirty minutes. Although it is possible that the aqueous solution could be contacted with the fibers by spraying, paddling, dipping or other means, it is most preferable to immerse the fibers in a bath formed by the aqueous solution. Using such immersion techniques, relatively short periods of time are necessary before polymerization may begin. For example, about 10 minutes is usually sufficient with adequate agitation or circulation of the aqueous solution.

After uniform dispersal, intimate contact and attachment of the monomer to the polymer fibers have been achieved, graft polymerization of the monomer on the fibers may be commenced with the use of a suitable polymerization initiator such as peroxide or persulfate compounds which are known in the art. The particular initiator selected will depend upon the particular polymer fiber, the particular monomer used and the speed or other conditions of the polymerization desired. The weight ratio of monomer to initiator may range from about 5000:1 up to about 1:20. If desired, the initiator may be added during the second step so long as it is not activated until uniform dispersal, intimate contact and attachment of the monomer with the fiber surfaces are achieved. The initiation of polymerization may then be carried out, such as by raising the temperature, changing the pH or changing some other condition which will activate the initiator.

The initiator is added slowly (continuously or portionwise) over a period of time instead of by complete addition in one application as in many prior art processes. It has been discovered that non-uniform polymerization may be caused by fast addition of initiator. The initiator is added over a period of time greater than 3 minutes, preferably ranging from 5–30 minutes, more preferably 15–20 minutes, while the substrate is in contact with heated aqueous monomer solution.

Finally, the polymerization is allowed to continue until a there has been substantial graft polymerization of the monomer on the polymer fibers to modify the surface properties of the fibers. Generally, a rather low degree of polymerization is desirable, since excessive polymerization will result in large amounts of homopolymer in the fibers and in the process equipment, which must be cleaned and washing out after completion of the process. Therefore, it is preferable to avoid polymerization which significantly clouds the treating solution, and such small polymers as will remain in solution are preferred.

To this end, it is preferable to carry out the process of the present invention using very low concentrations of monomer, such as in the range of about 0.01 to about 1.0 weight percent of the total solution and preferably about 0.02 to 0.5 weight percent of the solution. Such low concentrations allow easy control of the polymerization reaction so that a relatively clear solution is maintained throughout the process, and the processing equipment and fibers treated may be easily cleaned and washed out.

The add-on of graft polymer should be below 1.0 weight percent for synthetic fibers using MBA and N,N'-(1,2-dihydroxyethylene)-bis-acrylamide (glyoxal acrylamide) and below 2.0 weight percent for natural fibers. Optimum processing according to this embodiment results in the permanent add-on of about 0.6 weight percent or even less of graft polymer based upon the weight of the polymer fiber.

The treatment process described above is generally used before dyeing of the polyamide substrate and before any treatment of the substrate which would encapsulate or coat the substrate surface.

In a preferred embodiment of the process, the treated polyamide substrate is washed with an alkaline solution prior to dyeing to improve the uniformity of the dye process. Surprisingly, with fine denier nylons, a cool alkaline wash solution starting at a pH of about 8 or 9 does not produce a polyamide fabric with all retained acid being neutralized. Polyamides tenaciously retain acid and only under the influence of heat and relatively large amounts of alkali will the acid be released and neutralized. Any residual bound acid will contribute to unlevel dying with acid dyes. Finer denier fibers require more and stronger alkali. Experimentation with a specific fiber and various combinations of heat and alkali are within the scope of those having ordinary skill in this art. In the process of the invention, the treated polyamide substrate is washed with a warm alkaline rinse solution to a final pH of about 9–9.5. Suitable alkali solutions may contain any suitable alkali, e.g., phosphate, hydroxide, carbonate, ammonia organic amines, etc. A preferred alkali is sodium hydroxide.

Whereas many of the teachings of the prior art involved the treating of fibers in the absence of polymerization initiators to avoid homo-polymerization, the present embodiment employs polymerization initiators. Polymerization initiators are generally of four basic types, namely, peroxides, persulfates, acids and ceric compounds.

Non-limiting examples of polymerization initiators that may possibly be utilized in this embodiment include inorganic peroxides, e.g., hydrogen peroxide, barium peroxide, magnesium peroxide, etc., and various organic peroxy compounds illustrative examples of which are the dialkyl peroxides, e.g., diethyl peroxide, dipropyl peroxide, dilauryl peroxide, diolyeyl peroxide, distearyl peroxide, di-(tert.-butyl) peroxide and di-(tert.-amyl) peroxide, such peroxides often being designated as ethyl, propyl, lauryl, oleyl, stearyl, tert.-butyl and tert.-amyl peroxides; the alkyl hydrogen peroxides, e.g., tert.-butyl hydrogen peroxide (tert.-butyl hydroperoxide), tert.-amyl hydrogen peroxide (tert.-amyl hydroperoxide), etc.; symmetrical diacyl peroxides, for instance peroxides which commonly are known under such names as acetyl peroxide, propionyl peroxide, stearoyl peroxide, malonyl peroxide, succinyl peroxide, phthaloyl peroxide, benzoyl peroxide, etc.; fatty oil acid peroxides, e.g., coconut oil acid peroxides, etc.; unsymmetrical or mixed diacyl peroxides, e.g., acetyl benzoyl peroxide, propionyl benzoyl peroxide, etc.; terpene oxides, e.g., ascaridole, etc.; and salts of inorganic peracids, e.g.; ammonium persulfate and potassium persulfate.

When fibers are treated according to this embodiment, the reaction may also be initiated by ceric ions, for example, in the form of ceric salts such as ceric nitrate, ceric sulfate, ceric ammonium nitrate, ceric ammonium sulfate, ceric ammonium pyrophosphate, ceric iodate, and the like.

Non-limiting examples of suitable acids for use in this embodiment include hydrochloric, phosphoric, sulfuric, nitric, acetic, formic, oxalic, tartaric, monochloroacetic, dichloroacetic, trichloroacetic and similar acids. Formic and hydrochloric acid have been found to be particularly suitable in carrying out this embodiment. It is possible that an acid can function as both a catalyst and initiator, e.g., formic acid.

Non-limiting examples of unsaturated types of monomers that may possibly be utilized in this embodiment include N,N'-methylene-bis-acrylamide ($CH_2(NHCOCH{:}CH_2)_2$), N,N'-(1,2-dihydroxyethylene)-bis-acrylamide, acrylamide, acrylic acid, 2-propyn-1-ol, crotonic acid, tetraethylene glycol, styrene, alpha-methyl styrene, 1,1-diphenyl ethylene, alpha-vinyl naphthalene, vinylpyridine, 2-chloro-2,3-butadiene, methacrylic acid, methacrylamide, N-methylolacrylamide, N-methyl-N-vinyl formamide, N-vinyl pyrrolidone, 3-, 4- or 5methyl-N-vinyl pyrrolidone, vinyl oxyethylformamide, methyl acrylate, ethyl acrylate, octyl methyl methacrylate, vinylacrylate, acrylonitrile, methylacrylonitrile, acrylyl chloride, vinyl methyl ketone, methallylalcohol, acrolein, methacrolein, vinyl acetate, p-vinyl phenyl acetate, methylmethacrylate, vinyl chloride, vinylidene chloride, p-chlorostyrene, 2,5-dichlorostyrene, 1,1,7-trihydroperfluoroheptyl acrylate, methyl alpha-chloroacrylate, acrylyl cyanide, styrene sulfonic acid, salts and esters of styrene sulfonic acid and glycidyl methacrylate. The preferred monomers are N,N'-methylene-bis-acrylamide (MBA) and N,N'(1,2-dihydroxyethylene)-bis-acrylamide.

A monomer may function as an acid. MBA, for example, is slightly acidic in aqueous solution. It is also possible to use specifically modified monomer which can provide special characteristics to the fibers, or fabrics made therefrom, such as crease softness, lubricity (e.g., by including silicon groups on the monomer), adhesion, optical brightness, antibacterial, anti-fungal or anti-mildew properties, etc.

In a preferred embodiment with the monomer utilized selected from the group consisting of MBA and N,N'(1,2-dihydroxyethylene)-bis-acrylamide, and the polymer fibers are nylon 66, or nylon 6, the graft polymerization step of the process is conducted for a period of time between about 0.5 minutes and about 2 hours, preferably between about 1.0 minute and about 30 minutes, at a temperature of about 85° C. to 95° C. The amount of initiator in the treating solution is between about 0.0001 weight percent and 5.0 weight percent.

An illustrative preferred embodiment is to immerse the fibers in an aqueous solution at about 70° C. containing about 0.01 weight percent hydrochloric acid or about 0.03 weight percent muriatic acid, and about 0.04 weight percent MBA, rapidly raising the temperature of the solution to about 90° C. and agitating the fibers in the solution for about 10 minutes. Thereafter, about 0.04 weight percent of potassium persulfate is slowly added to the solution to initiate polymerization. The polymerization is continued for about 10 minutes, followed by draining the solution from the fibers and rinsing the fibers in alkaline solution, all weight percents being on the basis of percentage by weight of the total solution.

The particular monomer, acid and the initiator in the treating solution will vary widely depending upon such factors as the nature of the particular monomer, acid and initiator, the time and temperature of the treatment, and the nature and form of the fiber being treated. While certain concentrations may be fairly essential for a particular monomer, acid and initiator under a given set of treatment conditions, applicant cannot give general ranges which would apply to all monomers, acids and initiators under all conditions, but those of ordinary skill in the art will be able to optimize the concentrations by routine experimentation on the basis of the present disclosure.

Attaining the desired degree of treatment according to this embodiment would depend on the strength of the initiator and the concentration of the monomer and acid. Thus, for example, a strong initiator, one that is inherently strong and/or having a high concentration of initiator, would require a lower monomer concentration. Conversely, a weak initiator, one that is inherently weak and/or having a low concentration of initiator, would require a higher monomer concentration. In the latter case, the treatment according to this invention can be controlled by draining the initiator containing solution from the fabric once the desired extent of polymerization has been achieved.

After polymerization begins, such polymerization being a function of the concentration and type of the acid, the unsaturated monomer, fabric, initiator and the speed and type of the agitation equipment being used, the polymer fibers are allowed by remain in solution at the required temperature long enough to assure that uniform graft polymerization ("substantial polymerization") has occurred, such time usually not exceeding 30 minutes. The fibers must then be rinsed to neutralize the pH and remove excess homopolymers, if any.

The treated polyamide may then be dyed using conventional dyes for polyamide substrates and conventional dyeing equipment.

In yet another embodiment, a polyamide substrate may be treated using the process of the present invention in a continuous processing mode. In this embodiment, the polyamide is prepared and scoured as discussed above to remove knitting oils, waxes, etc. The water-soluble monomer, acid and initiator are separately dissolved in water and then mixed together using metering pumps and mixing manifolds. The mixed solutions are delivered to the pad of conventional pad/steam processing equipment which is well-known and used in carpeting and cotton-dyeing processes. The mixed solutions are contacted with the polyamide substrate at the padder. After squeezing to remove excess liquid, the substrate contacted with the monomer and initiator then enters a chamber containing saturated steam at about 98°–100° C. for a sufficient time to complete polymerization. Generally, a sufficient time is about 5–25 minutes, preferably about 10–15 minutes. The treated substrate is then rinsed with water for a time and at a temperature sufficient to remove acid and non-exhausted reactants. The fabric may then be dried and dyed in conventional dyeing apparatus. In this embodiment, it is not necessary to use a cross-linking hydrophobic monomer.

In a further embodiment, the treatment of a polyamide according to the invention is combined with dyeing of the polyamide substrate. Conventional polyamide dyeing processes use dye bath auxiliary chemicals in addition to the dyestuff. Among the products commonly used are acetic acid, sodium sulfate and leveling agents. Normal dyeing is begun by adding the auxiliary chemicals, setting the pH to about 5–5.5, adding the dyes and then increasing the temperature to about 90°–95° C. followed by holding at this dyeing temperature for about 30–60 minutes. At the end of the holding time, the fabric is dyed, but residual dyestuff remains in solution in the bath.

In the combined treatment/dyeing process of the invention, the water-soluble polymerizable monomer described above is added just prior to the dye. At the end of the dyeing cycle, a strong acid (e.g. $H_2SO_4$) is added to the dye bath over a period of about 5–30 minutes. As the pH drops to about 2–4, additional dissolved dye is forced out of solution into the fiber thereby improving the efficiency of the dyeing process. However, care must be taken to add the acid slowly to avoid unlevel dyeing. The rate of acid addition required to achieve a level dye result can be easily determined with a few simple preliminary tests by one having ordinary skill in this art. After the acid has completely dispersed, polymerization is begun by the addition of an initiator as described below. The initiator may be one of the initiators described above.

As in the embodiment described above, the initiator is added slowly over a period of time in contrast to prior processes in which the initiator is completely added in one portion in about 1–3 minutes. In this embodiment, the initiator is added over a period of time greater than 3 minutes, preferably ranging from 5–30 minutes, more preferably 10–15 minutes.

In a preferred embodiment, the dye bath is buffered using a buffer solution of TSPP and citric acid such that about 0.25 g/l of citric acid is neutralized with TSPP to pH 7. To this buffer solution, 1.6 g/l of an ethoxylated nonylphenol (nonionic surfactant) is added. With this buffer system, the initiator concentration is increased by about 50% and a durably grafted product is produced.

The combined dyeing/process for treating polyamide substrates of the invention is very useful for producing light shades of a dye since less dye remains in solution at the end of the dye cycle.

The polyamide substrates treated according to the present invention may be further processed into conventional fabric articles such as clothing articles. Clothing articles prepared from the treated fabric dry quickly and draw moisture away from the body providing improved wearing characteristics.

Each of the references cited in this specification are individually and specifically incorporated herein by reference in their entirety to provide a more complete description of the processes and fibers disclosed therein.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A process, comprising the steps of:

(a) contacting a polyester substrate with an aqueous monomer or monomer mixture;

(b) slowly adding a polymerization initiator to said contacted polyester substrate over a time period of greater than 3 minutes, wherein said contacted polyester substrate is heated to a temperature suitable for polymerization;

(c) polymerizing said monomers on said contacted polyester substrate to form a surface modified polyester substrate.

2. The process of claim 1, wherein said polyester substrate is contacted with a monomer mixture comprising a water-soluble vinyl monomer and a cross-linking hydrophobic vinyl monomer.

3. The process of claim 2, wherein said water-soluble vinyl monomer is selected from the group consisting of N,N'-methylenebisacrylamide, N,N'-(1,2dihydroxyethylene)bisacrylamide, acrylamide, acrylic acid, 2-propyl-1-ol, crotonic acid, tetraethylene glycol diacrylate, vinylpyridine, methacrylic acid, methacrylamide, 4-methylolacrylamide, N-methyl-N-vinyl formamide, N-vinyl pyrrolidone, 3-methyl-N-vinyl pyrrolidone, 4-methyl-N-vinyl pyrrolidone, 5-methyl-N-vinyl pyrrolidone, maleic acid, vinyl oxyethylformamide, acrylonitrile, methacrylonitrile, methallylalcohol, acrylyl cyanide, styrene sulfonic acid and water-soluble salts of styrene sulfonic acid.

4. The process of claim 3, wherein said water-soluble vinyl monomer is N,N'-methylenebisacrylamide or N,N'-(1,2-dihydroxyethylene)bisacrylamide.

5. The process of claim 2, wherein said cross-linking hydrophobic vinyl monomer is selected from the group consisting of bisphenol A dimethacrylate, ethylene glycol dimethacrylate, ethoxylated bisphenol A dimethacrylate, allyl acrylate, allyl methacrylate, 1,3-butylene glycol diacrylate, 1,3-butylene glycol dimethacrylate, 1,4-butanediol diacrylate, diallyl fumarate, diethylene glycol diacrylate, 2,2-dimethylpropane 1,3-diacrylate, 2,2-dimethylpropane 1,3-dimethacrylate, dipentaerythritol monohydroxypentaacrylate, ethoxylated bisphenol A diacrylate, 1,6-hexanediol diacrylate, 1,6-hexanediol dimethacrylate, pentaerythritol tetraacrylate, pentaerythritol triacrylate, pentaerythritol tetramethacrylate, trimethylolpropane triacrylate, trimethylolpropane trimethacrylate, and tripropylene glycol diacrylate.

6. The process of claim 5, wherein said cross-linking hydrophobic vinyl monomer is bisphenol A dimethacrylate, ethylene glycol dimethyacrylate or ethoxylated bisphenol A dimethacrylate.

7. The process of claim 2, wherein said polymerization initiator is added continuously or portion-wise over a time period ranging from 5 minutes to about 30 minutes.

8. The process of claim 7, wherein said polymerization initiator is a persulfate.

9. The process of claim 2, wherein said cross-linking hydrophobic vinyl monomer is combined with a surfactant and is in the form of an emulsion.

10. The process of claim 2, wherein said polymerization initiator is added to an aqueous solution of said watersoluble vinyl monomer in contact with said polyester substrate at a temperature of 80°–100° C.

11. The process of claim 2, wherein said polymerizing is conducted at a pH of about 2–4.

12. The process of claim 1, wherein said polyester contains anionic groups.

13. The process of claim 12, wherein said aqueous monomer mixture comprises a monomer selected from the group consisting of N,N'-methylenebisacrylamide, N,N'-(1,2-dihydroxyethylene)bisacrylamide, acrylamide, acrylic acid, 2propyl-1-ol, crotonic acid, tetraethylene glycol diacrylate, vinylpyridine, methacrylic acid, methacrylamide, 4-methylolacrylamide, N-methyl-N-vinyl formamide, N-vinyl pyrrolidone, 3-methyl-N-vinyl pyrrolidone, 4-methyl-N-vinyl pyrrolidone, 5-methyl-N-vinyl pyrrolidone, maleic acid, vinyl oxyethylformamide, acrylonitrile, methacrylonitrile, methalylalcohol, acrylylcyanide, styrene sulfonic acid and water-soluble salts of styrene sulfonic acid.

14. The process of claim 13, wherein said polymerization initiator is a cationic initiator selected from the group consisting of 2,2'-azobis(N,N'-dimethyleneisobutyrylamidine)dihydrochloride, 2,2'-azobis (2-amidinopropane)dihydrochloride and 2,2'-azobis(N,N'-dimethylenebisisobutyrylamidine).

15. The process of claim 14, wherein said cationic initiator is 2,2'-azobis(2-amidinopropane)dihydrochloride.

16. The process of claim 14, wherein said cationic initiator is added over a time period ranging from 5 to 30 minutes.

17. The process of claim 12, wherein said polymerizing is conducted at a pH of about 4–6.

18. The process of claim 12, wherein said polymerizing is conducted at a temperature of about 80°–100° C.

19. The process of claim 12, further comprising adding a salt before or during said polymerizing.

20. A process, comprising the steps of:

(a) mixing separate aqueous solutions of a water-soluble polymerizable monomer, a hydrophobic polymerizable monomer, an acid and a polymerization initiator to form a mixture;

(b) contacting a polyester substrate with said mixture to form a contacted polyester substrate; and (c) heating said contacted polyester substrate in saturated steam at a temperature of about 98°–100° C. for a time sufficient to polymerize said monomer mixture on said polyester substrate to form a surface modified polyester substrate.

21. A process, comprising the steps of:

(a) contacting a polyester substrate with an aqueous solution containing a dye, a portion of a water-soluble polymerizable monomer at a pH of about 4–6 and at a temperature of about 120°–135° C. to form a contacted polyester substrate in a dye bath;

(b) adding additional water-soluble polymerizable monomer to said dye bath;

(c) lowering the pH of said dye bath to a pH in the range of about 2–4;

(d) slowing adding a polymerization initiator to said dye bath over a time period of greater than 3 minutes; and (e) polymerizing said water-soluble polymerizable monomer on said contacted polyester substrate to form a surface modified polyester substrate.

22. The process of claim 21, further comprising cooling said dye bath to a temperature of about 80°–100° C. after contacting step (a).

23. A process, comprising the steps of:

(a) contacting a polyamide, acrylic, aramid or cellulosic substrate with an acidic aqueous solution containing an unsaturated water-soluble polymerizable monomer to form a contacted substrate;

(b) slowly adding a polymerization initiator to said contacted substrate over a time period of greater than 3 minutes, wherein said contacted substrate is heated to a temperature suitable for polymerization;

(c) polymerizing said water-soluble polymerizable monomer on said substrate to form a surface modified substrate.

24. The process of claim 23, wherein said unsaturated monomer is selected from the group consisting of N,N'-methylenebisacrylamide, N,N'-(1,2-dihydroxyethylene) bisacrylamide, acrylamide, acrylic acid, 2propyl-1-ol, crotonic acid, tetraethylene glycol diacrylate, vinylpyridine, methacrylic acid, methacrylamide, 4-methylolacrylamide, N-methyl-N-vinyl formamide, N-vinyl pyrrolidone, 3-methyl-N-vinyl pyrrolidone, 4-methyl-N-vinyl pyrrolidone, 5-methyl-N-vinyl pyrrolidone, maleic acid, vinyl oxyethylformamide, acrylonitrile, methacrylonitrile, methalylalcohol, acrylylcyanide, styrene sulfonic acid and water-soluble salts of styrene sulfonic acid.

25. The process of claim 23, wherein said unsaturated monomer is N,N'-methylenebisacrylamide or N,N'-(1,2-dihydroxyethylene)bisacrylamide.

26. The process of claim 23, wherein said polymerization initiator is added over a time period ranging from 5 minutes to 30 minutes.

27. The process of claim 23, further comprising:

(d) washing said surface modified substrate with an alkaline solution at a concentration and for a time sufficient to neutralize residual acid in said surface modified substrate.

28. The process of claim 27, wherein said alkaline solution contains hydroxide.

29. The process of claim 23, wherein said polymerization initiator is a persulfate.

30. A process, comprising the steps of:

(a) contacting a polyamide, acrylic, aramid or cellulosic substrate with an acidic aqueous solution containing a water-soluble polymerizable monomer;

(b) adding a dye to said aqueous solution containing said water-soluble monomer and heating said solution at a temperature and time sufficient to dye said substrate;

(c) lowering the pH of said solution to a pH of about 2–4;

(d) slowly adding a polymerization initiator to said solution over a time period of greater than 3 minutes; and (e) polymerizing said water-soluble polymerizable monomer on said substrate to form a dyed and surface modified substrate.

31. A process, comprising the steps of:

(a) mixing separate aqueous solutions of a water-soluble polymerizable monomer, an acid and a polymerization initiator to form a mixture;

(b) contacting a polyamide, acrylic, aramid or cellulosic substrate with said mixture to form a contacted substrate; and (c) heating said contacted substrate in saturated steam at a temperature of about 98°–100° C. for a time sufficient to polymerize said water-soluble polymerizable monomer on said substrate to form a surface modified substrate.

32. A surface modified polyester substrate prepared by the process of claim 1 wherein said polymerization initiator is added over a time period of from 10 to 15 minutes.

33. A surface modified polyester substrate prepared by the process of claim 21.

34. A surface modified substrate prepared by the process of claim 23 wherein said polymerization initiator is added over a time period of from 10 to 15 minutes.

35. A surface modified substrate prepared by the process of claim 27 wherein said polymerization initiator is added over a time period of from 10 to 15 minutes.

36. A surface modified substrate prepared by the process of claim 30.

37. A method of improving the uniformity of dyeing, hydrophilic, soil-release, odor-resistant, mildew-resistant, bacterial-resistant or fungal-resistant properties of a polyester, polyamide, acrylic, aramid or cellulosic substrate, comprising the steps of:

(a) contacting a polyester, polyamide, acrylic, aramid or cellulosic substrate with an aqueous monomer or monomer mixture;

(b) slowly adding a polymerization initiator to said contacted substrate over a time period of greater than 3 minutes, wherein said contacted substrate is heated to a temperature suitable for polymerization;

(c) polymerizing said monomers on said contacted substrate to form a surface modified substrate.

* * * * *